US007854189B1

(12) United States Patent
Fox

(10) Patent No.: US 7,854,189 B1
(45) Date of Patent: Dec. 21, 2010

(54) MODULAR MISSILE LAUNCHING ASSEMBLY

(75) Inventor: David L. Fox, Chesapeake, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 376 days.

(21) Appl. No.: 12/214,303

(22) Filed: Jun. 13, 2008

Related U.S. Application Data

(60) Provisional application No. 60/999,232, filed on Oct. 16, 2007.

(51) Int. Cl.
*F41F 3/04* (2006.01)
*F41A 23/02* (2006.01)
*B63G 1/00* (2006.01)

(52) U.S. Cl. ..... 89/1.804; 89/1.815; 89/38

(58) Field of Classification Search ..... 89/1.802, 89/1.804, 1.806, 1.815, 1.82, 38; 114/1, 114/176, 239; 254/93 R; 292/251.5
See application file for complete search history.

(56) References Cited

U.S. PATENT DOCUMENTS 925,707 A * 6/1909 Lake ..... 114/239
3,303,740 A * 2/1967 Grayson et al. ..... 89/1.815
3,340,768 A * 9/1967 Aldrin et al. ..... 89/1.815
4,031,838 A * 6/1977 Schmidt et al. ..... 114/1
4,106,389 A * 8/1978 Walley ..... 89/1.815
4,141,277 A * 2/1979 Bouillon ..... 89/38
4,470,336 A * 9/1984 Swann et al. ..... 89/1.815
4,573,396 A * 3/1986 Streetman et al. ..... 89/36.08
4,579,187 A * 4/1986 Taylor ..... 180/164
5,020,412 A * 6/1991 Adams ..... 89/1.805
6,907,812 B1 * 6/2005 Eckstedt ..... 89/37.01
2004/0069135 A1 4/2004 Fowler
2006/0207417 A1 9/2006 Shah et al.

* cited by examiner

*Primary Examiner*—Bret Hayes
(74) *Attorney, Agent, or Firm*—Dave A. Ghatt

(57) ABSTRACT

The invention is related to a modular missile launching assembly, more particularly, a compact modular missile launching assembly that is easily attachable to smaller sized watercrafts, allowing for quick installation. The missile launching assembly is encased in a substantially rectangular container with a launching lid to which one or more missiles are attached. A hydraulic lifting device within the substantially rectangular container is used to lift the launching lid from a closed or stowage position to an open or operational position.

20 Claims, 7 Drawing Sheets

MODULAR MISSILE LAUNCHING ASSEMBLY

CROSS-REFERENCE TO RELATED APPLICATIONS

This application claims the benefit of U.S. Provisional Application No. 60/999,232, filed Oct. 16, 2007, which is incorporated herein by reference.

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

TECHNICAL FIELD

The following description relates generally to a modular missile launching assembly, more particularly, a compact modular missile launching assembly that is easily installable to vehicles such as watercrafts.

BACKGROUND

Modern warships rely on missiles for armament. Typically, warships have missile launching systems permanently affixed to the hull of the ship. Missile launching assemblies tend to be bulky and are typically mounted to large warships. Additionally, because the missile launching assemblies tend to be bulky, it is almost impossible to mount missile assemblies onto smaller crafts without occupying a considerable amount valuable cargo space.

Consequently, it is desired to have a missile assembly that is compact enough to be attached to smaller watercrafts. It is also desired to have a missile assembly that is easily attachable and detachable to smaller watercrafts. It is further desired that the missile assembly is compact enough to be fitted to smaller watercrafts without having the adverse affect of reducing payload capabilities.

SUMMARY

In one aspect, the invention is a modular missile launching assembly for replaceably mounting to an upper deck surface of a small watercraft. In this aspect, the missile launching assembly includes a substantially rectangular container. The substantially rectangular container has a base plate forming the bottom of the substantially rectangular container, and a top plate forming the top of the substantially rectangular container. The container also includes a first side structure connected to the top plate and the base plate, the first side structure being positioned for alignment with a forward end of the watercraft. The container also includes a second side structure connected to the top plate and the base plate, the second side structure being positioned for alignment with an aft end of the watercraft. The substantially rectangular container also has a third side structure connected to the top plate and the base plate, the third side structure being positioned for alignment with the starboard side of the watercraft. A fourth side structure connected to the top plate and the base plate is also included, the fourth side structure being positioned for alignment with a port side of the watercraft. In this aspect the top plate includes a substantially rectangular outer lip for supporting the modular missile launching assembly on the upper deck of the watercraft. The top plate also includes a launching lid substantially encompassed by the substantially rectangular outer lip. The launching lid is pivotally attached to the outer lip of the top plate, and pivotable between a closed position and open positions. The launching lid has an underside which is inside the substantially rectangular container when the launching lid is in a closed position. The invention also includes one or more missile canisters attached to the underside of the launching lid, each of the one or more missile canisters equipped to carry a missile. Additionally, each missile canister has an attached exhaust, each exhaust connected to the underside of the launching lid.

In another aspect, the invention is a watercraft and modular missile launching arrangement. The arrangement includes a watercraft having a hull having one or more decks. The one or more decks includes an upper deck having an upper deck surface including a forward end surface, an aft end surface, a port side surface and a starboard side surface. The upper deck further includes a substantially rectangular upper deck opening, the substantially rectangular upper deck opening surrounded by the upper deck surface. In this aspect, the invention also includes a modular missile launching assembly positioned substantially within the upper deck opening. The modular missile launching assembly has a substantially rectangular container that includes a base plate forming the bottom of the substantially rectangular container. The substantially rectangular container also includes a top plate forming the top of the substantially rectangular container, a first side plate connected to the top plate and the base plate, the first side plate aligned with the forward end surface of the upper deck. The rectangular container of the modular missile launching assembly also includes a second side plate connected to the top plate and the base plate, with the second side plate aligned with the aft end surface of the upper deck. The rectangular container further includes a third side plate connected to the top plate and the base plate, the third side plate aligned with the starboard side surface of the upper deck, and a fourth side plate connected to the top plate and the base plate, the fourth side plate aligned with the port side surface of the upper deck. In this aspect the top plate includes a substantially rectangular outer lip attached to the upper deck surface surrounding the substantially rectangular upper deck opening, for supporting the modular missile launching assembly on the upper deck of the watercraft. Also included is a launching lid substantially encompassed by the substantially rectangular outer lip. The launching lid being pivotally attached to the outer lip of the top plate, and pivotable between a closed position and open positions. The launching lid has an underside which is inside the substantially rectangular container when the pivotable top plate is in a closed position. The invention also includes one or more missile canisters attached to the underside of the launching lid, each of the one or more missile canisters equipped to carry a missile. Each missile canister has an attached exhaust, the exhaust attached to the underside of the launching lid.

In another aspect, the invention is a method of replaceably arming a watercraft. The method includes the providing of a watercraft. According to the method, the watercraft is provided with a hull having one or more decks, the one or more decks including an upper deck having an upper deck surface. The upper deck surface includes a forward end surface, an aft end surface, a port side surface and a starboard side surface. The upper deck further includes a substantially rectangular upper deck opening, the substantially rectangular upper deck opening surrounded by the upper deck surface. The method further includes the providing of a modular missile launching assembly. The modular missile launching assembly includes a substantially rectangular container, the container having a base plate forming the bottom of the substantially rectangular container, and a top plate forming the top of the substantially rectangular container. The substantially rectangular container is further provided with a first side plate connected to the top plate and the base plate, a second side plate connected to the top plate and the base plate, a third side plate connected to the top plate and the base plate, and a fourth side plate connected to the top plate and the base plate. In this aspect, the top plate has a substantially rectangular outer lip, and a launching lid substantially encompassed by the substantially rectangular outer lip. The launching lid is pivotally attached to the outer lip of the top plate, and pivotable between a closed position and open positions. The launching lid has an underside which is inside the substantially rectangular container when the pivotable top plate is in a closed position. Also provided is one or more missile canisters attached to the underside of the launching lid, each of the one or more missile canisters equipped to carry a missile. Each missile canister has an attached exhaust, with the exhaust attached to the underside of the launching lid. In this aspect, the method includes the inserting of the modular missile launching assembly into the substantially rectangular opening in the upper deck so that the substantially rectangular outer lip of the modular missile launching assembly contacts and rests on the upper deck surface surrounding the opening. The method also includes the attaching of the outer lip of the modular missile launching assembly to the upper deck surface by using clamps, bolts, screws, electromechanical devices, and combinations thereof.

BRIEF DESCRIPTION OF THE DRAWINGS

Other features will be apparent from the description, the drawings, and the claims.

DETAILED DESCRIPTION

Figure 1A:
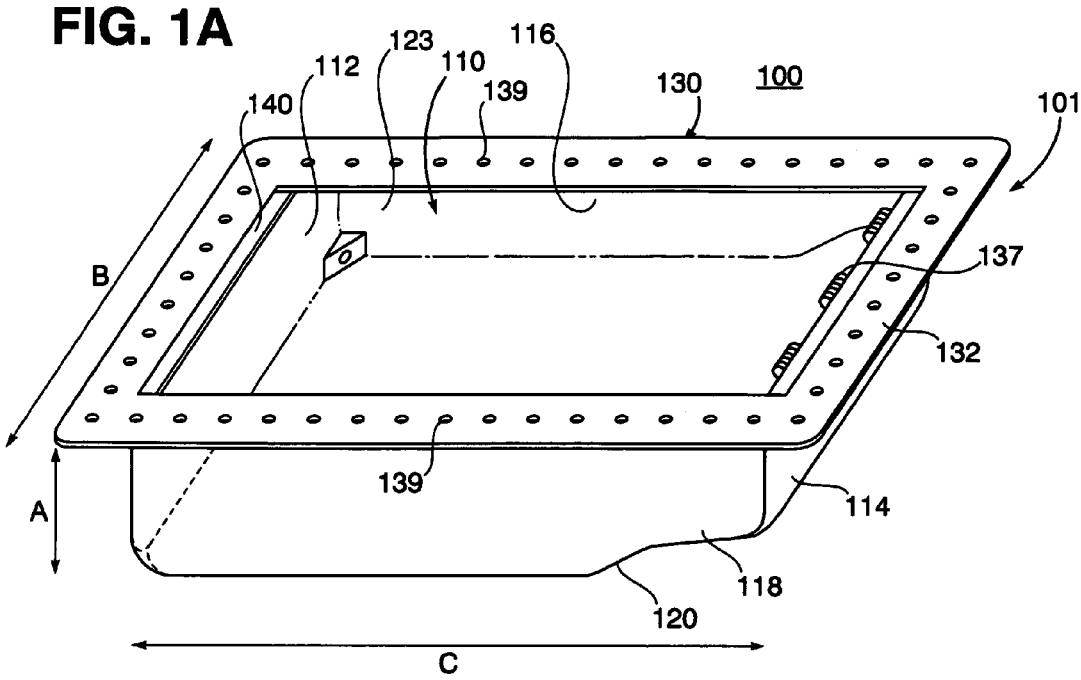
FIG. 1A is a schematic illustration of a modular missile launching assembly, according to an embodiment of the invention.

FIG. 1A is a schematic illustration of a substantially rectangular container 101 of a modular missile launching assembly 100, according to an embodiment of the invention. The modular missile launching assembly 100 is designed for easy and expedient attachment to a vehicle such as a watercraft. As shown, the substantially rectangular container 101 includes a top plate 110 and a base plate 120. As shown, the substantially rectangular container 101 also includes side structures, 112, 114, 116, and 118. The side structures 112, 114, 116, and 118 may be plate-like structures, and each structure 112, 114, 116, and 118 extends from the base plate 120 to the top plate 110, thereby forming the hollow substantially rectangular box 101. It should be noted that even though the base plate 120, and side structures 112, 114, 116, and 118 are different elements of the container 101, these elements form a continuous tub-like structure. The modular missile assembly may made from one or more different materials, such as aluminum, steel, fiberglass, carbon fiber, or other materials depending on the applications involved, as well as combinations of these materials.

Figure 1B:
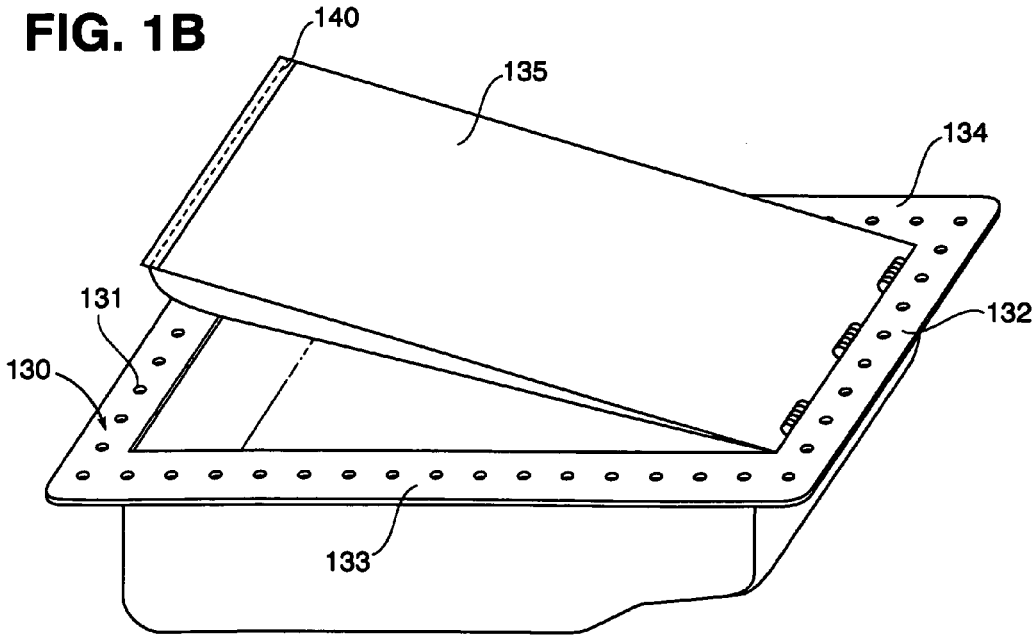
FIG. 1B is a schematic illustration of a modular missile launching assembly, according to an embodiment of the invention.

FIGS. 1A and 1B both show the top plate 110 having a substantially rectangular outer lip 130 and a launching lid 135. The launching lid 135 is pivotally attached to the outer lip 130 via a hinge device 137, about which the lid pivots. As shown, the outer lip 130 overhangs the side structures 112, 114, 116, and 118. FIGS. 1A and 1B show a first lip portion 131, second lip portion 132, a third lip portion 133, and a fourth lip portion 134. As will be outlined below, the overhanging outer lip 130 functions to replaceably attach the modular missile launching assembly 100 to a deck surface of a vehicle such as a watercraft. FIGS. 1A and 1B also show a front end 140 of the launching lid 135, the front end 140 extending so that when the lid 135 is closed, the front end 140 rests on the fist lip portion 131. FIG. 1A shows the container 101 having a height A, a width B, and a length C. In one exemplary embodiment, the height A may be about 12 inches to about 20 inches. According to the exemplary embodiment, the width B may be about 30 inches to about 60 inches, and the length C may be about 60 inches to about 84 inches.

FIG. 1A also shows drainage port 123 attached to base plate 120. The base plate 120 may be sloped in the so that water or other liquids under the force of gravity runs down the slope to the drainage port 123. The draining of liquids may be assisted by suctioning devices. Although one drainage port 123 is shown, any desired amount of drainage outlets may be used. In multiple drainage port arrangements, all are preferably located on one side of the container 101 to minimize connection conduits when the container is attached to a vehicle such as a watercraft. FIG. 1A also shows receiving holes 139 in the outer lips 131, 132, 133, and 134. As will be outlined below, the holes 139 are for receiving fastening elements such as bolts, screws, and the like, when the modular missile launching assembly is attached to vehicle such as a watercraft.

Figure 2A:
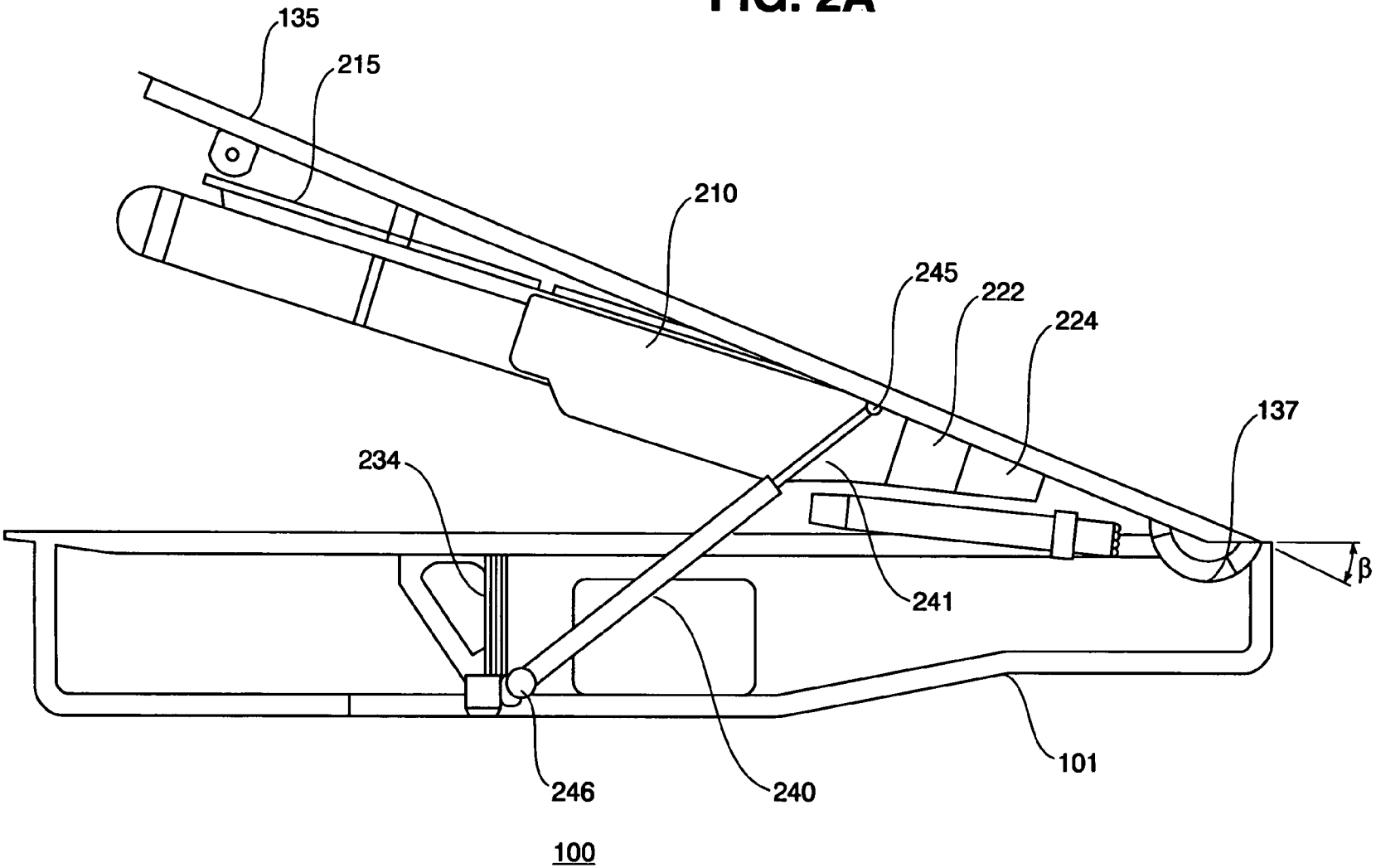
FIG. 2A is side view of a modular missile launching assembly according to an embodiment of the invention.
Figure 2B:
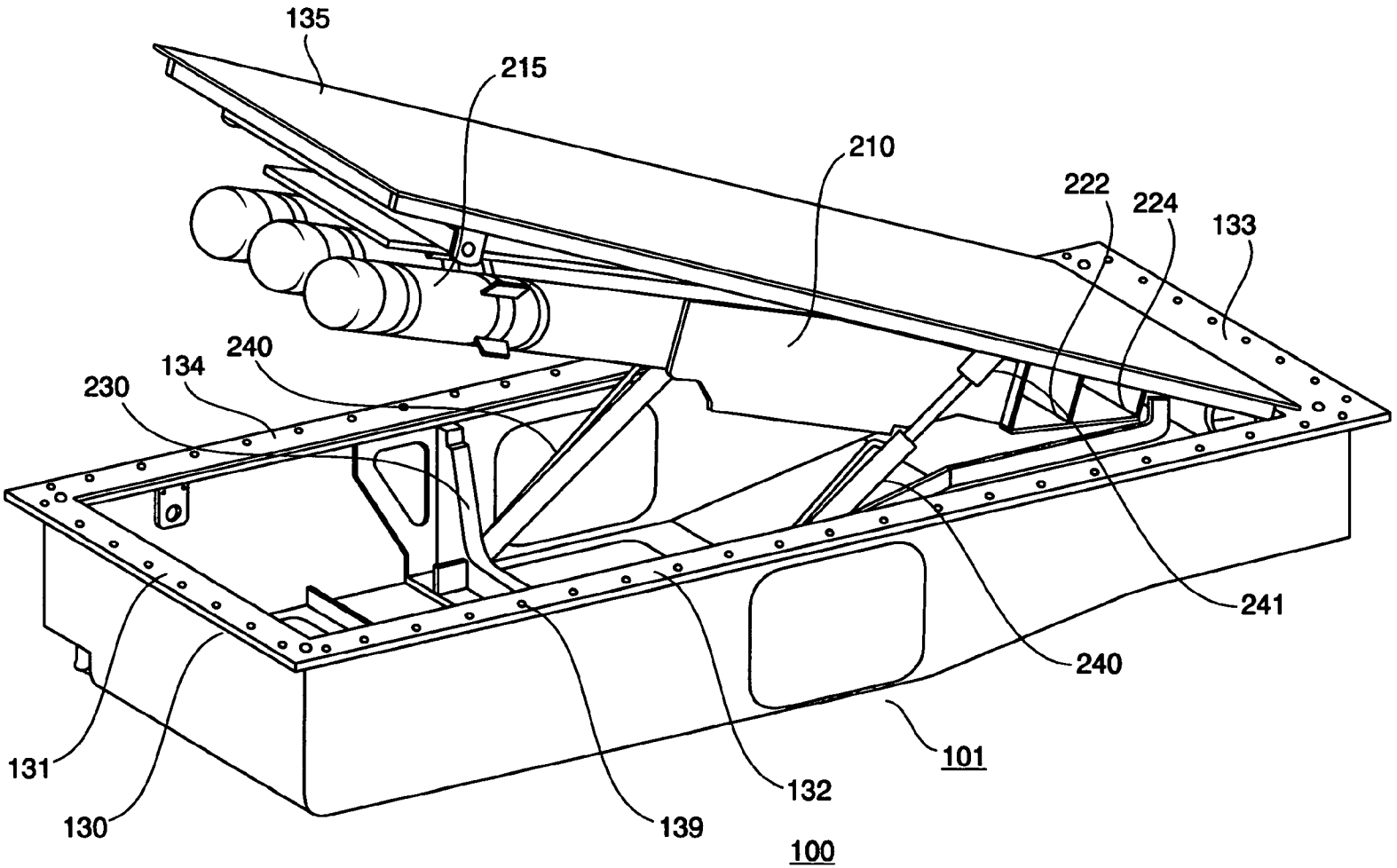
FIG. 2B is a perspective view of a modular missile launching assembly according to an embodiment of the invention.
Figure 2C:
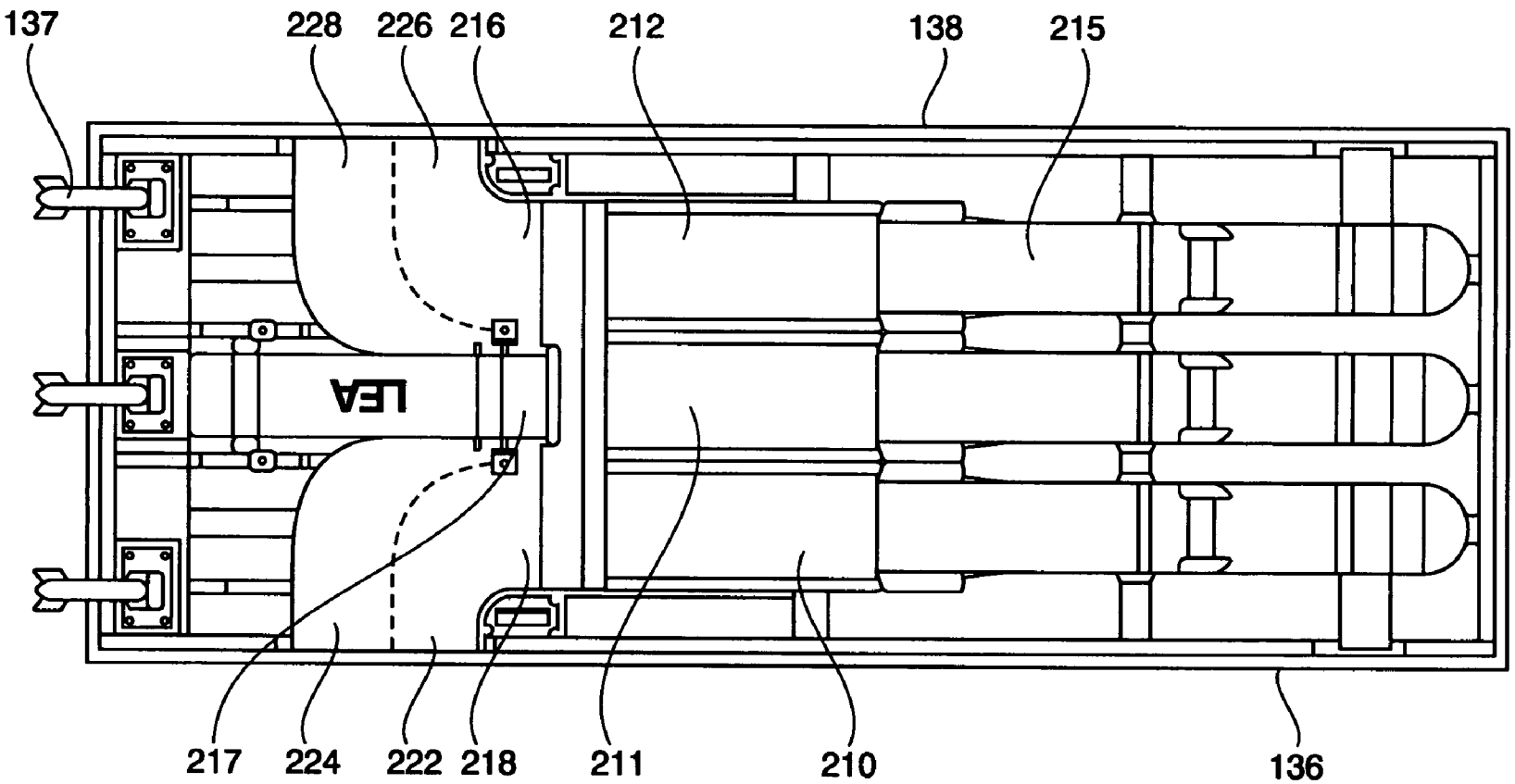
FIG. 2C is a perspective top view of a modular missile launching assembly according to an embodiment of the invention.

FIG. 2A is a sectional view of the modular missile launching assembly 100 showing elements inside the substantially rectangular container 101. FIG. 2A shows a missile canister 210 attached to an underside of the launching lid 135. As shown, a missile 215 may be carried in the canister 210. FIG. 2B is a perspective view of the assembly 100, and FIG. 2C is a perspective top view of the assembly. FIGS. 2B and 2C show the plurality of canisters 210, 211, and 212 for carrying and launching missiles 215. FIG. 2C shows the arrangement of the canister exhausts 216, 217, and 218 leading to exhaust outlets 222, 224, 226, and 228. As illustrated, exhaust outlet 222 positioned at side edge 136 of the lid 135, is associated with a single canister 210. FIG. 2C also shows exhaust outlet 226 positioned at opposite side edge 138 of the lid 135, being associated with a single canister 212. The exhaust from middle canister 211 is branched into two conduits, with outlets 224 and 228, at opposite sides 136 and 138 respectively, of the arrangement. Alternatively, the middle canister 211 may be connected to a single undivided exhaust outlet that is positioned at one of the side edges. Although FIGS. 2B and 2C show three canisters, the assembly 100 may include less than three canisters or more than three canisters.

FIGS. 2A and 2B show at least one hydraulic device 240 for lifting the launching lid 135 a desired angle of elevation for launching the attached missiles 210. The hydraulic device 240 may also be used to lock the lid 135 in a closed position. The hydraulic device 240 may preferably include an electronic actuator for controlling the lifting extension of hydraulic arm for controlling the movement of the launching lid 135 into a launch ready position. FIG. 2A shows the angle of elevation β above the horizontal of the launching lid 135. The angle of elevation β ranges from a closed 0 degree elevation to about 50 degrees elevation, with a preferred range of about 35 degrees to about 45 degrees for launching missiles. The electronic actuator may control lifting at 5 degree increments. FIG. 2A shows the launching lid 135 elevated at an angle β so that the exhaust outlets 222 and 224 are exposed. Typically, an elevation angle of about 10 degrees is enough to wholly lift the exhaust outlets out of the container 101, so that exhaust fumes are released into the atmosphere.

FIG. 2B shows a substantially U-shaped bottom support 230 running along base plate 120 and side structures 116 and 118. FIGS. 2A and 2B show each hydraulic device 240 having a vertically extending arm 241 that is hingedly connected to an undersurface of the lid 135 via a pivotable link 245. The hydraulic device 240 may also be connected to the U-shaped bottom support 230 via a pivotable link 246. The pivotable link 245 maybe be directly attached to the underside of the lid 135, or may be attached to the lid via a support bracket.

Figure 3A:
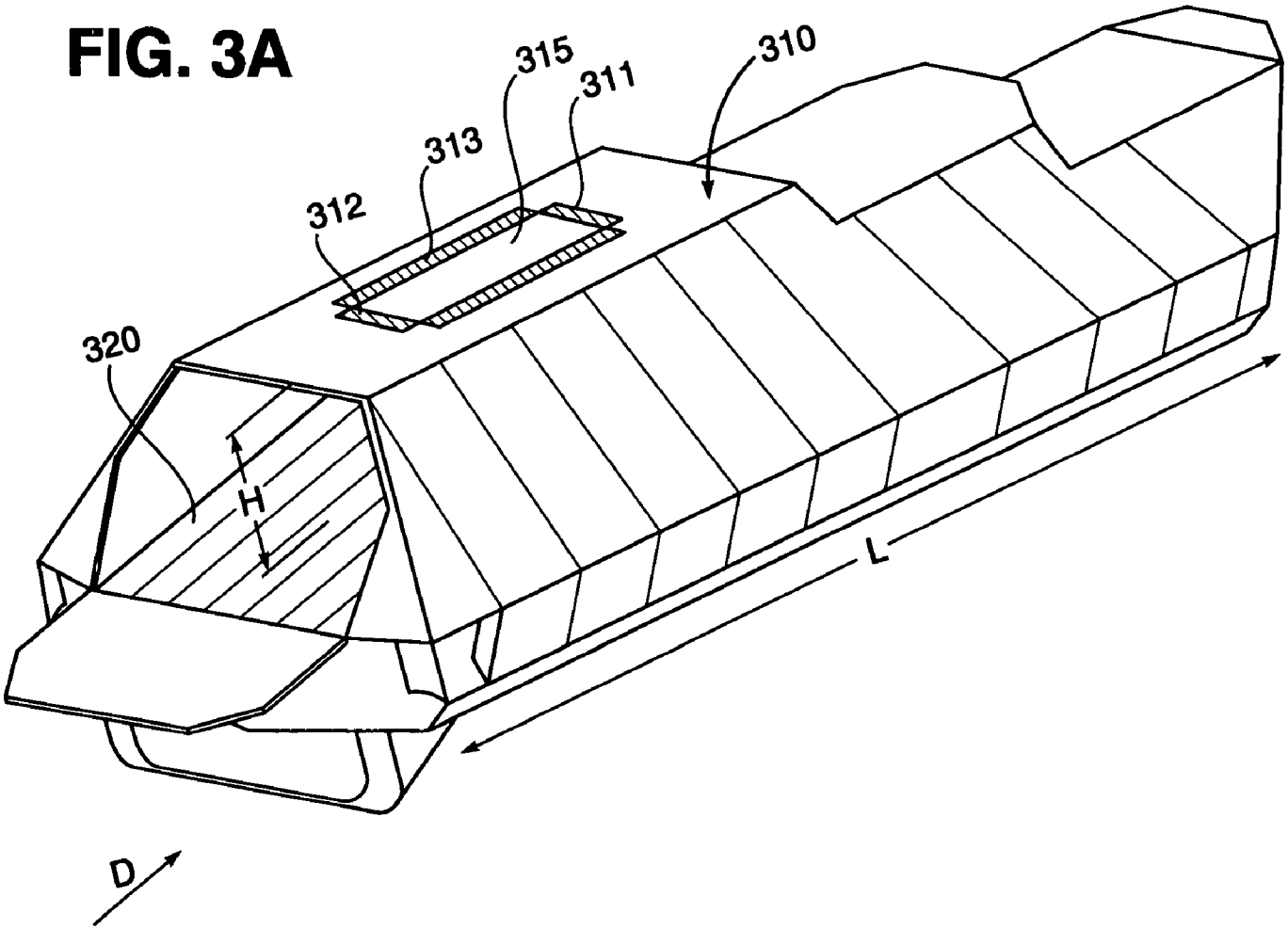
FIG. 3A is a perspective view of a watercraft for receiving a modular missile launching assembly.

FIG. 3A is a perspective view of a watercraft 300 for receiving a modular missile launching assembly 100. The watercraft 300 may be of any desired size, may have numerous decks, and may be operate either above the water surface, below the water surface, or combination thereof. In one exemplary embodiment, the watercraft 300 has an upper deck 310, and a lower deck 320. As shown, the upper deck 310 and the lower deck may be separated by a distance of H. The distance H may be about 4 ft to about 5 feet or more. As shown, the upper deck 310 has a substantially rectangular opening 315 for receiving the modular missile launching assembly 100. The dimensions of the opening 315 are commensurate with the dimensions of the missile launching assembly. FIG. 3A includes an arrow 333 representing the direction of travel. Based on the direction of travel, the upper surface surrounding the hole/opening 315 may be divided into four zoned surfaces, i.e., a forward end surface 311, an aft end surface 312, a starboard side surface 313, and a port side surface 314, as shown by the hatched patterns in FIG. 3A. The hatched patterns are for illustrative purposes only, and do not signify material differences on the upper deck 310. FIG. 3A shows the watercraft having a length L. In one embodiment, the length L may be about 30 feet to about 150 feet or longer.

Figure 3B:
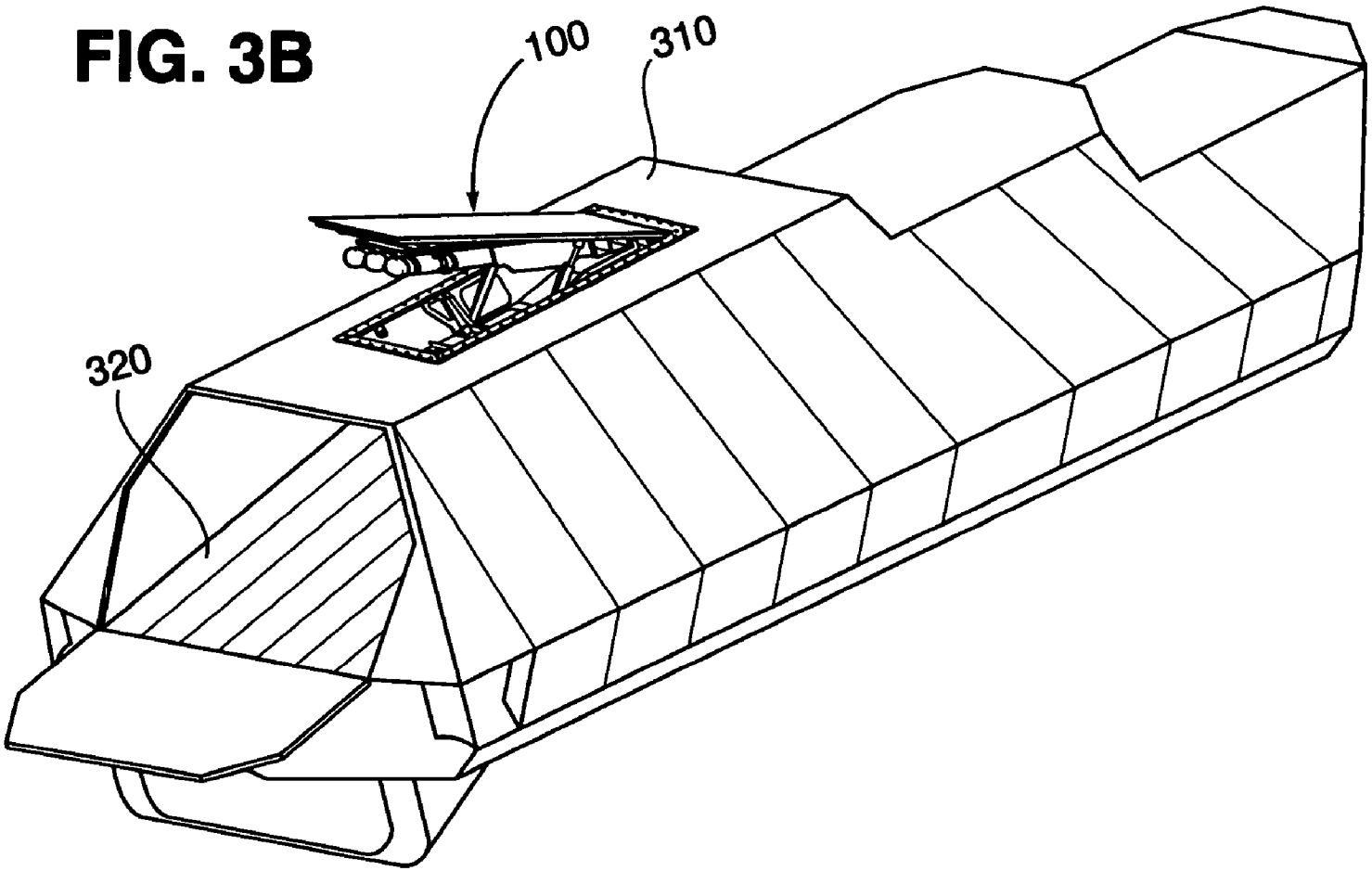
FIG. 3B is a perspective view of a modular missile launching assembly attached to a watercraft.

FIG. 3B is a perspective view of a modular missile launching assembly 100, as outlined above, attached to a watercraft 300, also outlined above. The assembly 100 is attached to the watercraft 300 by being mounted into the substantially rectangular opening 315. When the missile assembly 100 is inserted, the outer lip portion 130 shown in FIGS. 1-2C contacts the upper deck surface surrounding the opening 315. The modular missile launching assembly 100 may be securely attached to the watercraft 300 by clamps, bolts, screws, electromechanical devices, and combinations thereof. For example, an electromechanical device having a solenoid and a connected plunger may be used to move bolts into a securing position, such as the receiving openings 139 on the outer lip 130 shown in FIGS. 1A and 2C. Alternatively, screws may be manually threaded through the openings. In yet another exemplary fastening arrangement, a combination of electromechanical and manual fastening devices may be used. Any of the above outlined arrangements expedite the installation of the modular missile launching assembly onto the watercraft. In fact, this modular missile launching assembly may be swapped out to another watercraft in approximately 20 minutes, using only two men and a crane.

The opening 315 in the upper deck may be oriented in any desired manner to allow for the insertion of the modular missile launching assembly 100 in any desired orientation. In the exemplary embodiment shown in FIG. 3A, the modular missile launching assembly is mounted so that the first outer lip portion 131 is aligned with the forward end surface 311, the second outer lip portion 132 is aligned with the aft end surface 312, the third outer lip portion 277 is aligned with the starboard side surface 313, and the fourth outer lip portion 134 is aligned with the port side surface 314.

FIG. 3B shows the modular missile launching assembly 100 with the launching lid 135 in an open position. It should be noted that in the closed position, the missile launching assembly keeps missile fumes within the container, thereby reducing the possibility of detecting missile signatures. When the modular missile launching assembly is attached to a watercraft 300, as shown in FIG. 3B, the modular missile launching assembly 100 projects downward into the space between the two decks. As outlined above, FIG. 1A shows the container 101 having a height A, a width B, and a length C. In one exemplary embodiment, the height A may be about 12 inches to about 20 inches. According to the exemplary embodiment, the width B may be about 30 inches to about 60 inches, and the length C may be about 60 inches to about 84 inches. Because the upper deck 310 is separated from the lower deck by a distance of about 48 inches to about 60 inches, the assembly 100 takes up little of the overhead space, leaving the payload bay with a majority of its original capabilities. Depending on the embodiment, clearance between the lower deck 320 and the base plate 120 of the container 101 may be about 28 inches to about 48 inches.

Figure 4:
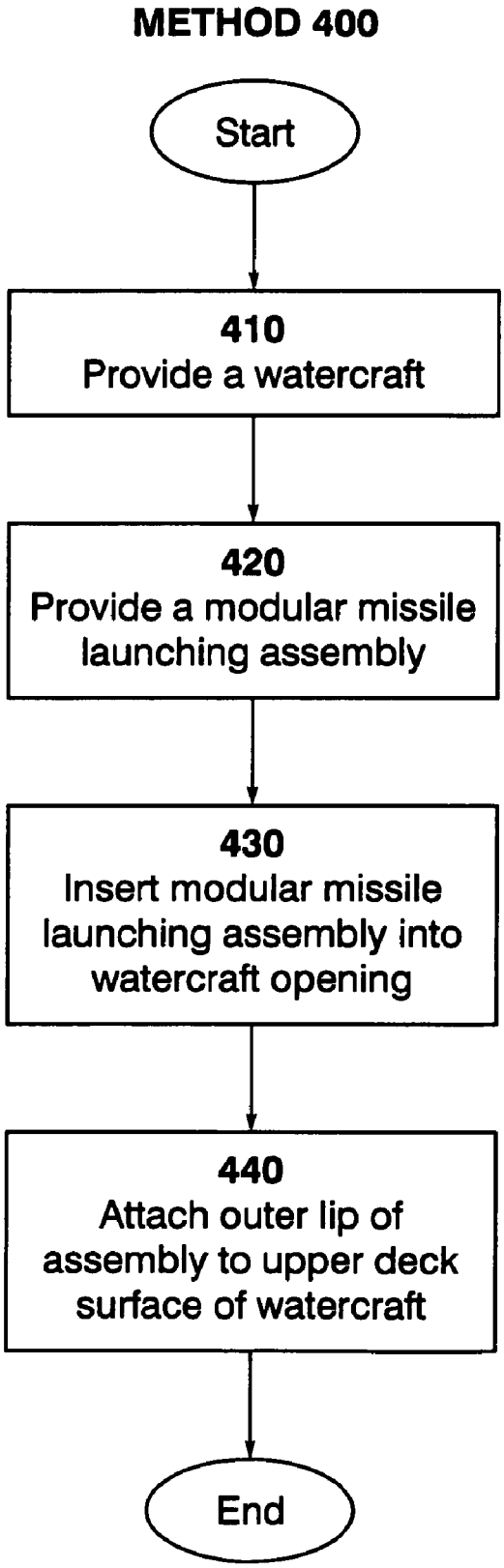
FIG. 4 is a flowchart showing a method of replaceably arming a watercraft, according to an embodiment of the invention.

FIG. 4 is a flowchart showing a method 400 of replaceably arming a watercraft, according to an embodiment of the invention. The steps involved in the method 400 of arming a watercraft have been outlined above in detail in the description with respect to FIGS. 1A-3B. Step 410 is the providing of a watercraft 300 having one or more decks, including an upper deck 310 having a substantially rectangular opening 315, as outlined above with respect to FIG. 3A. Step 420 is the providing of a modular missile launching assembly 100, as outlined above with respect to FIGS. 1A, 1B, 2A, 2B, and 2C.

Step 430 is the inserting of the modular missile launching assembly 100 into the substantially rectangular opening 315 in the upper deck. According to this step, the substantially rectangular outer lip 130 of the modular missile launching assembly 100 contacts and rests on the upper deck surface surrounding the opening 315. Step 440 is the attaching of the outer lip 130 of the modular missile launching assembly to the upper deck surface by using clamps, bolts, screws, electromechanical devices, and combinations thereof. As outlined above, the outer lip 130 may include receiving holes therein for receiving fastening elements such as bolts, screws and the like.

What has been described and illustrated herein are preferred embodiments of the invention along with some variations. The terms, descriptions and figures used herein are set forth by way of illustration only and are not meant as limitations. For example, the modular missile launching assembly may be mounted on a land-based vehicle, or may be used in stationary applications. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. A modular missile launching assembly for replaceably mounting to an upper deck surface of a small watercraft, the missile launching assembly comprising:

a substantially rectangular container comprising:

a base plate forming the bottom of the substantially rectangular container;

a top plate forming the top of the substantially rectangular container;

a first side structure connected to the top plate and the base plate, the first side structure positioned for alignment with a forward end of the watercraft;

a second side structure connected to the top plate and the base plate, the second side structure positioned for alignment with an aft end of the watercraft;

a third side structure connected to the top plate and the base plate, the third side structure positioned for alignment with the starboard side of the watercraft; and a fourth side structure connected to the top plate and the base plate, the fourth side structure positioned for alignment with a port side of the watercraft;

wherein the top plate comprises:

a substantially rectangular outer lip for supporting the modular missile launching assembly on the upper deck of the watercraft; and a launching lid substantially encompassed by the substantially rectangular outer lip, the launching lid pivotally attached to the outer lip of the top plate, and pivotable between a closed position and open positions, the launching lid having an underside which is inside the substantially rectangular container when the launching lid is in a closed position; and one or more missile canisters attached to the underside of the launching lid, each of the one or more missile canisters equipped to carry a missile, each missile canister having an attached exhaust, each exhaust connected to the underside of the launching lid.

2. The modular missile launching assembly of claim 1, further comprising:

one or more hydraulic lifting devices, each hydraulic lifting device having a first end and a second end, a hydraulic lift bottom support attached to the base plate;

a pivotable link member attached to the underside of the launching lid, wherein the first end of each of the one or more hydraulic lifting devices is attached to the hydraulic lift bottom support and the second end of each of the one or more hydraulic lifting devices is attached to the pivotable link member.

3. The modular missile launching assembly of claim 2, wherein the substantially rectangular outer lip comprises:

a first lip portion for alignment with the forward end surface of the watercraft;

a second aft lip portion for alignment with the aft end surface of the watercraft;

a third lip portion for alignment with the starboard side surface of the watercraft; and a fourth lip portion for alignment with the port side surface of the watercraft, and wherein the one or more hydraulic lifting devices are vertically extendable to pivot the launching lid to an angle of elevation from about 0 degrees to about 50 degrees to enable the launching of missiles within the canisters.

4. The modular missile launching assembly of claim 3, the launching lid comprises:

a first edge substantially parallel to a launching direction, and a second edge substantially parallel to the first edge, wherein the one or more missile canisters attached to the underside of the launching lid comprises three missile canisters, the three missile canisters comprising:

a first missile canister adjacent to the first lid edge;

a second missile canister adjacent to the second lid edge; and a third missile canister between the first missile canister and the second missile canister, wherein the first missile canister is connected to a first exhaust having an exhaust outlet located on the first lid edge, the second missile canister is connected to a second exhaust having an exhaust outlet on the second lid edge, and the third missile canister connected to a third exhaust which branches into two branched exhaust outlets, wherein one of the branched exhaust outlets is on the first lid edge and the other branched exhaust outlet is on the second lid edge.

5. The modular missile launching assembly of claim 4, wherein when the hydraulic lifting extends vertically to pivot the launching lid at an angle of elevation of about 10 degrees, the exhaust outlets are exposed above the level of the substantially rectangular outer lip, to allow the unhindered dispensation of missile exhaust fumes.

6. The modular missile launching assembly of claim 5, wherein the hydraulic lift bottom support is U-shaped having a middle portion and two substantially parallel outer portions, wherein the middle portion of the U-shaped support is fastened to base plate, one of the outer portions is attached to the third side plate, and the other of the outer portions is attached to the fourth side plate, and wherein a drainage outlet for draining liquids is included in the substantially rectangular container.

7. The modular missile launching assembly of claim 4, wherein the substantially rectangular container has a height of about 12 inches to about 20 inches, a width of about 30 inches to about 60 inches, and a length of about 60 inches to about 84 inches.

8. The modular missile launching assembly of claim 7, wherein the substantially rectangular container comprises, one of aluminum, steel, fiberglass, carbon fiber, or combinations thereof.

9. A watercraft and modular missile launching arrangement comprising:

a watercraft comprising a hull having one or more decks, the one or more decks comprising:

an upper deck having an upper deck surface including a forward end surface, an aft end surface, a port side surface and a starboard side surface, the upper deck further including a substantially rectangular upper deck opening, the substantially rectangular upper deck opening surrounded by the upper deck surface;

a modular missile launching assembly positioned substantially within the upper deck opening, the modular missile launching assembly comprising:

a substantially rectangular container comprising:

a base plate forming the bottom of the substantially rectangular container;

a top plate forming the top of the substantially rectangular container;

a first side plate connected to the top plate and the base plate, the first side plate aligned with the forward end surface of the upper deck;

a second side plate connected to the top plate and the base plate, the second side plate aligned with the aft end surface of the upper deck;

a third side plate connected to the top plate and the base plate, the third side plate aligned with the starboard side surface of the upper deck; and a fourth side plate connected to the top plate and the base plate, the fourth side plate aligned with the port side surface of the upper deck;

wherein the top plate comprises:

a substantially rectangular outer lip attached to the upper deck surface surrounding the substantially rectangular upper deck opening, for supporting the modular missile launching assembly on the upper deck of the watercraft; and a launching lid substantially encompassed by the substantially rectangular outer lip, the launching lid pivotally attached to the outer lip of the top plate, and pivotable between a closed position and open positions, the launching lid having an underside which is inside the substantially rectangular container when the pivotable top plate is in a closed position; and one or more missile canisters attached to the underside of the launching lid, each of the one or more missile canisters equipped to carry a missile, each missile canister having an attached exhaust, the exhaust attached to the underside of the launching lid.

10. The watercraft and modular missile launching arrangement of claim 9, wherein the modular missile launching assembly further comprises:

one or more hydraulic lifting devices, each hydraulic lifting device having a first end and a second end, a hydraulic lift bottom support attached to the base plate;

a pivotable link member attached to the underside of the launching lid, wherein the first end of each of the one or more hydraulic lifting devices is attached to the hydraulic lift bottom support and the second end of each of the one or more hydraulic lifting devices is attached to the pivotable link member.

11. The watercraft and modular missile launching arrangement of claim 10, wherein in the modular missile launching assembly the substantially rectangular outer lip comprises:

a first lip portion aligned with the forward end surface of the upper deck;

a second lip portion aligned with the aft end surface of the upper deck;

a third lip portion aligned with the starboard side surface of the upper deck; and a fourth lip portion aligned with the port side surface of the watercraft, and wherein the one or more hydraulic lifting devices are vertically extendable to pivot the launching lid to an angle of elevation from about 0 degrees to about 50 degrees to enable the launching of missiles within the canisters.

12. The watercraft and modular missile launching arrangement of claim 11, wherein in the closed position the top plate forms a substantially continuous surface with the upper deck surface, and wherein the substantially rectangular outer lip includes a plurality of receiving holes for receiving fastening devices to attach the modular missile launching assembly to the upper deck of the watercraft.

13. The watercraft and modular missile launching arrangement of claim 12, the launching lid comprises:

a first edge substantially parallel to a launching direction, and a second edge substantially parallel to the first edge, wherein the one or more missile canisters attached to the underside of the launching lid comprises three missile canisters, the three missile canisters comprising:

a first missile canister adjacent to the first lid edge;

a second missile canister adjacent to the second lid edge; and a third missile canister between the first missile canister and the second missile canister, wherein the first missile canister is connected to a first exhaust having an exhaust outlet located on the first lid edge, the second missile canister is connected to a second exhaust having an exhaust outlet on the second lid edge, and the third missile canister connected to a third exhaust which branches into two branched exhaust outlets, wherein one of the branched exhaust outlets is on the first lid edge and the other branched exhaust outlet is on the second lid edge.

14. The watercraft and modular missile launching arrangement of claim 13, wherein when the hydraulic lifting extends vertically to pivot the launching lid at an angle of elevation of about 10 degrees, the exhaust outlets are exposed above the level of the substantially upper deck surface, to allow the unhindered dispensation of missile exhaust fumes.

15. The watercraft and modular missile launching arrangement of claim 14, wherein the hydraulic lift bottom support is U-shaped having a middle portion and two substantially parallel outer portions, wherein the middle portion of the U-shaped support is fastened to base plate, one of the outer portions is attached to the third side plate, and the other of the outer portions is attached to the fourth side plate, and wherein a drainage outlet for draining liquids is included in the substantially rectangular container.

16. The watercraft and modular missile launching arrangement of claim 15, wherein the substantially rectangular container has a height of about 12 inches to about 20 inches, a width of about 30 inches to about 60 inches, and a length of about 60 inches to about 84 inches.

17. The watercraft and modular missile launching arrangement of claim 16, wherein the one or more decks of the watercraft comprise a second deck below the upper deck, wherein clearance between the lower deck and the base plate of the modular missile launching assembly is about 48 inches to about 60 inches.

18. The watercraft and modular missile launching arrangement of claim 15, further including a fastening assembly attaching the substantially rectangular outer lip of the modular missile launching assembly to the uppers deck surface, wherein the fastening assembly comprises one or more electromechanical clamps, bolts, screws, and combinations thereof.

19. A method of replaceably arming a watercraft comprising:

providing a watercraft comprising:

a hull having one or more decks, the one or more decks comprising:

an upper deck having an upper deck surface including a forward end surface, an aft end surface, a port side surface and a starboard side surface, the upper deck further including a substantially rectangular upper deck opening, the substantially rectangular upper deck opening surrounded by the upper deck surface;

providing a modular missile launching assembly comprising:

a substantially rectangular container comprising:

a base plate forming the bottom of the substantially rectangular container;

a top plate forming the top of the substantially rectangular container;

a first side plate connected to the top plate and the base plate;

a second side plate connected to the top plate and the base plate;

a third side plate connected to the top plate and the base plate; and a fourth side plate connected to the top plate and the base plate;

wherein the top plate comprises:

a substantially rectangular outer lip; and a launching lid substantially encompassed by the substantially rectangular outer lip, the launching lid pivotally attached to the outer lip of the top plate, and pivotable between a closed position and open positions, the launching lid having an underside which is inside the substantially rectangular container when the pivotable top plate is in a closed position; and one or more missile canisters attached to the underside of the launching lid, each of the one or more missile canisters equipped to carry a missile, each missile canister having an attached exhaust, the exhaust attached to the underside of the launching lid;

inserting the modular missile launching assembly into the substantially rectangular opening in the upper deck so that the substantially rectangular outer lip of the modular missile launching assembly contacts and rests on the upper deck surface surrounding the opening;

attaching the outer lip of the modular missile launching assembly to the upper deck surface by using clamps, bolts, screws, electromechanical devices, and combinations thereof.

20. The method of claim 19, wherein the watercraft is provided with a hull length of about 30 feet to about 150 feet, the water craft further provided with a lower hull at a vertical distance of about 48 inches to about 60 inches below the upper deck, and the substantially rectangular container of the modular missile launching assembly is provided with a height of about 12 inches to about 20 inches, a width of about 30 inches to about 60 inches, and a length of about 60 inches to about 84 inches, wherein clearance between the lower deck and the base plate of the modular missile launching assembly is about 28 inches to about 48 inches.

* * * * *